US006557529B2

(12) United States Patent
Boecking

(10) Patent No.: US 6,557,529 B2
(45) Date of Patent: May 6, 2003

(54) PRESSURE-CONTROLLED INJECTOR WITH FORCE-BALANCING CAPACITY

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/035,558

(22) Filed: Nov. 7, 2001

(65) Prior Publication Data

US 2002/0084349 A1 Jul. 4, 2002

(30) Foreign Application Priority Data

Nov. 7, 2000 (DE) ..... 100 54 992

(51) Int. Cl.[7] ..... F02M 37/04; F02M 47/02
(52) U.S. Cl. ..... 123/467; 123/496; 239/36
(58) Field of Search ..... 123/446, 447, 123/467, 496; 239/88–96

(56) References Cited

U.S. PATENT DOCUMENTS 4,279,385 A * 7/1981 Straubel ..... 239/96
4,627,571 A * 12/1986 Kato et al. ..... 239/96
4,662,338 A * 5/1987 Itoh et al. ..... 123/467
5,333,786 A * 8/1994 Gant et al. ..... 123/446
5,901,685 A * 5/1999 Noyce et al. ..... 123/467
6,085,726 A * 7/2000 Lei et al. ..... 123/467
RE37,241 E * 6/2001 Gustafson ..... 123/496

FOREIGN PATENT DOCUMENTS

DE 37 28 817 C2 3/1992
DE 198 35 494 A1 2/2000

* cited by examiner

*Primary Examiner*—Thomas Moulis
(74) *Attorney, Agent, or Firm*—Michael J. Striker

(57) ABSTRACT

A fuel injector for an internal combustion engine has an injector housing having a pressure releasable control chamber for a vertical stroke movement and an annular chamber, an injector body closeable by the annular chamber, an inlet connectable to a high pressure collecting chamber and connected to and emptying into the annular chamber, an injection nozzle having a nozzle inlet and a nozzle chamber, with the nozzle inlet opened or closed by a sealing surface, a hydraulic spring associated with the injector body and including a control element impinged with high pressure via a volume of the hydraulic spring and via the inlet.

11 Claims, 1 Drawing Sheet

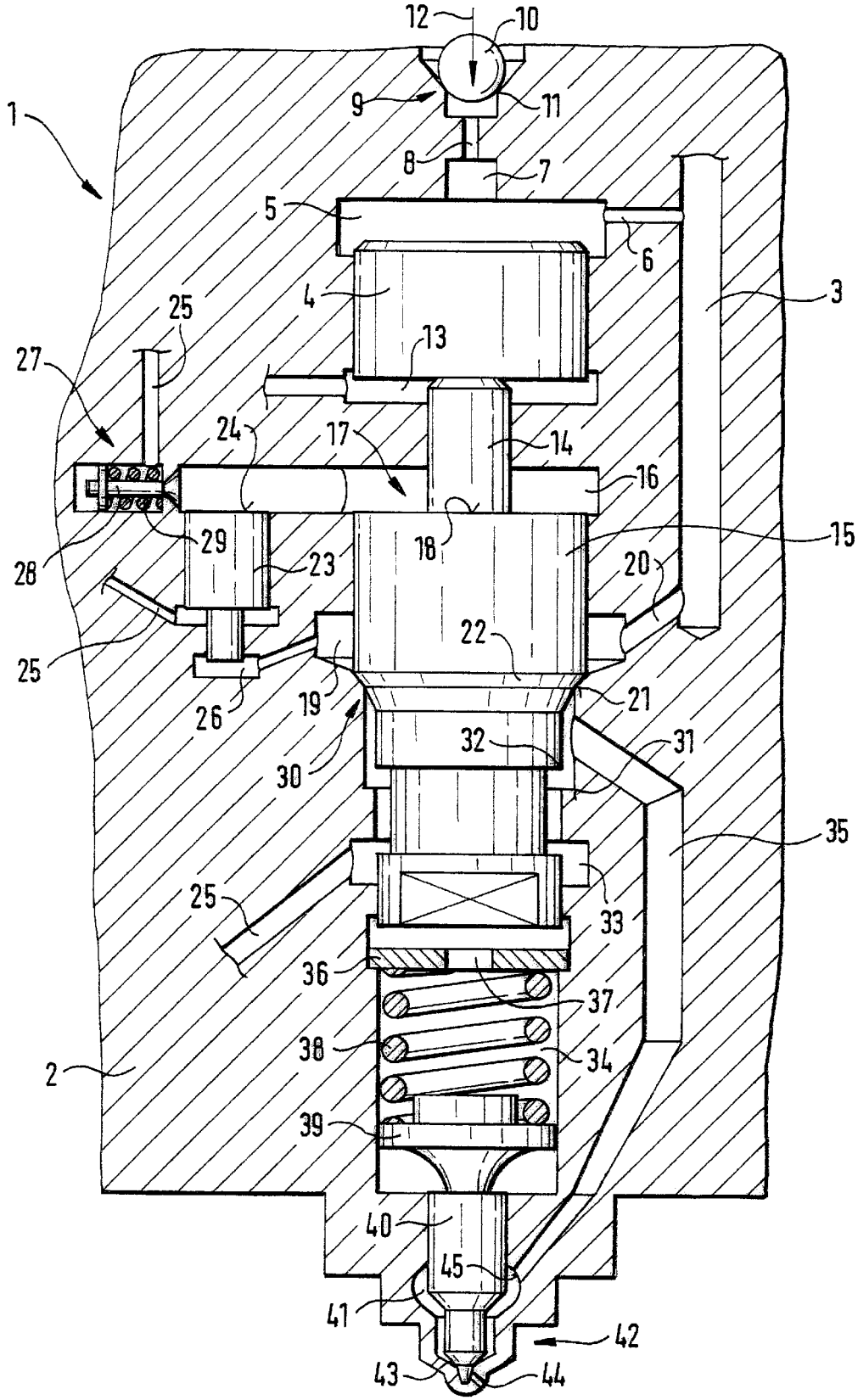
12
10
9
11
1
8
7
5
6
4
3
25
13
27
24
17
14
16
28
29
18
15
23
20
25
22
26
19
21
32
31
30
35
25
33
36
37
38
34
2
39
40
45
41
42
43
44

PRESSURE-CONTROLLED INJECTOR WITH FORCE-BALANCING CAPACITY

BACKGROUND OF THE INVENTION

The present invention relates to a pressure-controlled injector with force-balancing capacity.

In the modern injection systems for direct injection of internal combustion engines it is required that the injection pressure and the injection volume for which operational point of the engine can be determined independently from one another. In connection with this, an additional degree of freedom is created for the formation of mixture. In addition it is required that the injection volume at the beginning of the injection is as small as possible in order to take into account the ignition delay. These requirements are taken into consideration by injection systems with high pressure collecting chambers (common rail).

The patent document DE 198 35 494 A1 discloses a pump-nozzle unit. The unit serves for supplying the fuel into a combustion chamber of a direct-injection internal combustion engine. A pump unit is provided, with which an injection pressure is created. Fuel is injected via the injection nozzle into the combustion chamber. The pump-nozzle unit includes a control unit as well as a control portion. The control portion is formed as an outwardly opening A-valve, and by means of a valve operating unit is controllable for regulation of the pressure build-up in the pump unit. In order to create a pump-nozzle unit with a control unit which has a simple construction, is compact and has a short response time, the valve operating unit is formed as a piezoelectric actuator.

Patent document DE 37 28 817 C2 discloses a fuel injection pump for a combustion engine, which includes a pressure portion for pressurizing the fuel, a nozzle portion for injecting the pressurized fuel, and a control portion arranged between a pressure portion and the nozzle portion. The control portion intersects a fuel supply line that connects the pressure portion with the nozzle portion. Its end is formed as a control or regulating bore, which passes into an opening connected to the fuel return channel. In the channel, a control valve member is provided, which is movable by an electric operating unit between an opened position in which the fuel supply line and the fuel return channel are connected via the control bore and a closed position in which the control bore is closed.

The operating unit has a longitudinally adjustable piezoelectric element which is connected to a drive piston. Its free face is opposite to a substantially smaller face of a drive tappet, which is adjusted mechanically by the control valve member. The free face of the drive piston is separated from the smaller face of the tappet by a hollow chamber filled with incompressible fuel. In the drive tappet, a passageway is formed which connects the hollow chamber with the fuel return channel in which a check valve is disposed for closing the passage way when the pressure in the hollow chamber exceeds the pressure in the fuel return channel. The check valve opens the passageway when the pressure in the hollow chamber is smaller than the pressure in the fuel return channel.

In addition, it is known to provide additional throttle positions in the injection process in order to approximate an ideal triangular form for the injection process. In connection with this, however, the stroke is affected on the one hand, while on the other hand additional throttle positions on the injector must be provided.

SUMMARY OF THE INVENTION

Accordingly, it is an object of the present invention to provide a pressure-controlled injector which avoids the disadvantages of the prior art.

In accordance with the present invention an injector for injecting high pressure fuel into the combustion chamber of an internal combustion engine is designed so that a triangular pressure process can be realized without negatively affecting the pressure through a separate throttle position.

In keeping with these objects and with others which will become apparent hereinafter, one feature of present invention resides, briefly stated in an injector for an internal combustion engine, comprising an injector housing having a pressure releasable control chamber for a vertical stroke movement and an annular chamber; an injector body closeable by said annular chamber; an inlet connectable to a high pressure collecting chamber and connected to and emptying into said annular chamber; an injection nozzle having a nozzle inlet and a nozzle chamber, with said nozzle inlet opened or closed by a sealing surface, a hydraulic spring associated with said injector body and including a control element impinged with high pressure via a volume of said hydraulic spring and via said inlet.

In accordance with the present invention, a hydraulic spring is integrated in the injector housing of the injector so that an upper face of the injector body and a face of an adjacent control element represent limiting areas of the control volume of the hydraulic spring. High pressure from a high pressure collecting chamber (common rail) accumulates at the opposite side of the control element, as well as in a valve chamber surrounding the injector body. Depending on the cross sectional area of the control element, various prevailing pressures in the high pressure receiving chamber are taken into consideration, so that with large strokes of the injector body and the nozzle needles, a regulation of the high pressure takes place.

Through the design of the hydraulic spring with respect to the control volume, as well as the effective hydraulic diameter of the injector body, the rigidity as well as the spring force of the hydraulic spring can be affected. A piston is admitted between the pins on the surface of the injector body, which projects into the hydraulic spring and the control chamber that controls the electrical movement of the injector body. The piston turns its vertical movement upon a pressure chain of the associated control chamber to the injector body. The pin diameter and the effective piston diameter of the injector body, which is vertically displaceable in the housing of the injector significantly affect the rigidity and spring force of the hydraulic spring element.

The control element can be formed simply as a control piston, from the manufacturing technology prospective, and the hydraulic cross-section definitely affects the control behavior upon higher nozzle needle strokes in view of the prevailing pressure in the high pressure collecting chamber.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a view showing a longitudinal cross-sectional view taken through a housing of the injector in accordance with the present invention, with vertically overlapping injector bodies and control pistons as well as a control volume acting as a hydraulic spring.

DESCRIPTION OF THE PREFERRED EMBODIMENTS

FIG. 1 shows an injector 1 for injecting pressure fuel into the combustion chamber of an internal combustion engine in accordance with the present invention. The injector has an injector housing 2 and an injector body 15 within the housing which is vertically movable in the injector housing. A high pressure collecting chamber 3 (common rail) is provided coaxially to the axis of symmetry of the cylindrical injector body 5, as well as to a piston 4 cooperating therewith. The high pressure collecting chamber has two branches. The piston 14 is located above the injector body 15 in the injector housing. A control surface of the piston extends into a control chamber 5 which is supplied with a high pressure fuel volume from the high pressure collecting chamber 3 through a control chamber inlet 6. A fixed high pressure from the high pressure collecting chamber stands in the control chamber 5.

The control volume can be released into the control chamber 5 by a release opening 7 to which an outlet throttle 8 is connected. In connection with this, the force affecting a ball element 10 in the direction of the arrow 12 is reduced by means of a 2/2-way control valve 9 which is not shown in detail. The ball element 10 shown here as an example acts as a sealing element, and can be also formed as a magnet valve or as a piezo actuator. Upon regulation of the actuator or magnetic valve, the force acting on the ball closure element 10 is reduced so that the sealing seat 11 is released and a pressure release of the control chamber 5 is provided. Subject to the pressure release in the control chamber, the piston 4 extending with its end side of the control chamber 5 travels upwardly in a vertical direction. A waste oil chamber 13 is formed beneath the end side of the piston 4 which projects into the control chamber 5 with a various oil line 25 branching off to a valve 27.

Coaxially to the piston, a pin 14 is provided in the housing 2 of the injector 1. It is received on an end face of the injector body 15. A pin 14 is in contact with the piston 4 and penetrates a hydraulic spring 16 located above the piston surface 18.

The diameter of the pin 14 above the injector body 15 as well as the diameter of the injector body 15 in the area of the face 18 determine the effective working hydraulic surface 18. The control volume received in the housing 2 of the injector 1, moreover, is limited by a piston surface 24 which is formed on a control element 23 arranged parallel to the injector body 15, or to the pin 14. The hydraulic spring 17 can be pressure-released by means of a valve 27 which is shown schematically. The valve arrangement 27 closes off a waste oil line which comes from the waste oil chamber 13 beneath the piston 4 and empties on a valve tappet 28. The valve tappet 28 provided with a plate is biased by a spiral spring element and is pressed into its closed position through the prevailing pressure in the volume 17 of the hydraulic spring 16.

A branch to a waste oil line 27 as well as a control chamber 26 is disposed beneath the control element 2. It is connected to a valve chamber 19 which surrounds the injector body 15 via an opening in the housing 2 of the injector 1. The valve chamber 19 which surrounds the injector body is connected on one side with the high pressure collecting chamber 3 by an opening 20, so that in the control chamber 25 always a high pressure exists as that in the high pressure collecting chamber 3. Since this pressure varies, it is necessary that the hydraulic spring 16 will be cutoff from the prevailing pressure in the high pressure collecting chamber 3 upon greater strokes of the valve body 15, or the nozzle needle 40. This problem is addressed by constructing the diameter of the control piston which serves as a control element 23 such that starting from a certain known nozzle needle spoke 4, the pressure in the high pressure receiving chamber 3 is interrupted.

Beneath the valve chamber 19 which surrounds the injector body 15, a pressure stage 30 is formed. A sealing surface 22 is disposed on the pressure stage 30 and cooperates with the sealing seat on the housing side. It opens or closes the nozzle inlet 35 to the nozzle chamber 41 of the injector nozzle 42. The nozzle inlet formed as a bore of the housing 2 of the injector 1 runs substantially parallel to the axis of symmetry of the injector body 15 in the housing of the injector. Beneath the opening of the nozzle inlet 35 and the injector housing 2, a further annular chamber 33 is disposed, which is connected to a waste oil line.

By regulating the valve body 15 through pressure release of the control chamber 5 via control of the 2/2 way valve regulating actuator by means of a slide bar 32 which cooperates with the leading edge 31, the nozzle inlet 35 is released into the waste oil line 25 via the annular chamber 23. Beneath the annular chamber 33, a further waste oil chamber is located in the injector housing as well as disc-shaped support element which has a central opening 37. A hollow chamber 34 is connected to a disc 36 supported in the injector housing 2 and is limited by a ball-shaped pressure piece 39. A sealing spring formed as a spiral spring is positioned between the disc 36 and the ball-shaped pressure piece 39. The spiral spring constantly acts on the ball-shaped element 39 with its biasing force. The ball-shaped element 39 is always in contact with an end face of the nozzle needle 40.

The nozzle needle 40 whose longitudinal extension is greatly shortened in FIG. 1, is surrounded approximately centrally in the longitudinal extension by a nozzle chamber 41. The nozzle inlet line 35 empties into the nozzle chamber 41 and the nozzle chamber is both opened and closed by the sealing seat 21, 22 of the injector body 15. The opening of the nozzle inlet line 35 in the nozzle chamber 41 is identified with reference numeral 45 in FIG. 1. Upon pressurizing of the nozzle chamber 41 by fuel introduced therein, the fuel flows along the nozzle needle 40 in direction of the injection nozzle 42. The nozzle needle 40 of the injection nozzle 42 includes a seat face 43 which, upon vertical movement of the nozzle needle 40 by the vertical movement of the injector body 15 or the pin 14, releases an upward movement of these components. Thereby the seat 43 of the injection nozzle 42 is released, so that the high pressure fuel volume in the nozzle chamber 41 can be injected in corresponding amounts through the opening 44 into the combustion chamber of the internal combustion engine.

The relaxation-free force equalization of balancing is produced by the hydraulic spring 15 arranged beneath the waste oil chamber 13. Its control volume is limited by the affective surface 18 of the injector body 15 as well as the piston surface 24 of the control element 23. Upon opening of the 2/2-way valve 9 by operation of the actuator 12 against the spark direction the flow forces at work during the opening phase which has a dynamic nature can be absorbed on the injector body 15. The flow forces acting during the opening phase of the injector body 15 can cause a spontaneous opening of the injector body 15 against the forces opposing the opening, since a greater amount of fuel can arrive in the combustion chamber of the internal combustion engine, while the ignition delay at the beginning the injection would mean that a smaller amount of high pressure fuel would be provided to the combustion chamber. The spontaneous opening of the injector body 18 can be taken into consideration with the inventive solution of a hydraulic spring.

The design of the control element 23 which is formed preferably as a control piston allows a predetermined middle stroke of the nozzle needle 40 which cuts off the pressure in the high pressure collecting chamber 3. The pressure and the high pressure collecting chamber 3 can receives various pressure levels and is fixed via the high pressure collecting chamber inlet and the annular chamber 19 which surrounds the injector body 15, and therefore in the control chamber 26 of the control element 23. The relaxation free working hydraulic spring makes possible a holding of the spontaneous opening movement of the injector body 15 in the housing 2, so that it is always ensured that the nozzle needle 40 always opens so wide that for example an exactly metered amount of fuel can be injected into the combustion chamber to start the injection process with consideration of the ignition delay. In the injector shown in FIG. 1 with the pressure release of the control chamber 5 and thereby the piston 4 extending in it and the injector body 15 moved upwardly in the vertical direction, the pressure acting in the high pressure collecting chamber 3 acts at the sealing seat 21, 22, at the nozzle inlet 35 and thereby at the nozzle chamber 41 which surrounds the nozzle needle 40. The nozzle needle 40 opens at a predetermined adjustable pressure so that the high pressure fuel volume in the nozzle chamber can be injected into the combustion chamber of the internal combustion engine.

By means of the hydraulic spring 16 between the injector body 15 and the piston 4, it is ensured that the pressure pulsations which can lead to overshooting of the injector body 15 in the housing are effectively damped. Since the hydraulic spring has a relaxation-free damping property, with the selected configuration a pressure equalization can be realized at the injector body 15 in its open condition. A pressure equalization in the injector body sets the mechanical loads which act on this component significantly lower, so that its service life is considerably increased by the improved strength of this component.

The injector 1 formed in accordance with the present invention represents a system with a simple construction which has a substantially triangular pressure process, without influencing this pressure process by a special throttle. The provision of a special throttle which is unfavorable from manufacturing point of view always influences the pressure course negatively since in practice pressure losses at the injection nozzle 42 are unavoidable.

It should be mentioned for completeness that the 2/2 way control valve which serves for changing the fuel volume received in the control chamber 5 can be formed either as a magnetic valve or as a piezo actuator which has short response times. Moreover, also a combination of the piezo actuator and a magnetic valve can be used for actuation of the 2/2-way valve.

It will be understood that each of the elements described above, or two or more together, may also find a useful application in other types of constructions differing from the types described above.

While the invention has been illustrated and described as embodied in pressure-controlled injector with force-balancing capacity, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A fuel injector for an internal combustion engine, comprising an injector housing having a pressure releasable control chamber for a vertical stroke movement and an annular chamber; an injector body closeable by said annular chamber; an inlet connectable to a high pressure collecting chamber and connected to and emptying into said annular chamber; an injection nozzle having a nozzle inlet and a nozzle chamber, with said nozzle inlet opened or closed by a sealing surface, a hydraulic spring associated with said injector body and including a control element impinged with high pressure via a volume of said hydraulic spring and via said inlet.

2. A fuel injector as defined in claim 1; and further comprising a piston element arranged above said hydraulic spring and lying on a pin of said injector body, said piston element initiating a vertical stroke movement which a pressure change occurs in said control chamber.

3. A fuel injector as defined in claim 1, wherein said control element and said injector body have effective faces which limit a volume of said hydraulic spring.

4. A fuel injector as defined in claim 1, wherein said hydraulic spring is pressure releasable by a valve against oil leakage.

5. A fuel injector as defined in claim 1, wherein said hydraulic spring has a rigidity determined by a piston face of said injector body and a volume of said hydraulic spring.

6. A fuel injector as defined in claim 1, wherein said control element has a cross-sectional surface which controls a high pressure inlet depending on the stroke of a nozzle needle.

7. A fuel injector as defined in claim 1, wherein said injector body has a pressure stage in an area of said annular chamber.

8. A fuel injector as defined in claim 1, wherein said control chamber and said annular chamber are connectable to said high pressure collecting chamber.

9. A fuel injector as defined in claim 2; and further comprising a waste oil chamber disposed beneath said piston element, said waste oil chamber being connected with said hydraulic spring by a waste oil line and a valve tappet.

10. A fuel injector as defined in claim 1; and further comprising a 2-2/way valve actuatable by a magnetic valve.

11. A fuel injector as defined in claim 1; and further comprising a 2/2-way valve actuatable by a piezo actuator.

* * * * *